US011175604B1

(12) United States Patent
Koike

(10) Patent No.: US 11,175,604 B1
(45) Date of Patent: Nov. 16, 2021

(54) IMAGE FORMING APPARATUS AND STORAGE DEVICE

(71) Applicant: TOSHIBA TEC KABUSHIKI KAISHA, Tokyo (JP)

(72) Inventor: Sho Koike, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/023,708

(22) Filed: Sep. 17, 2020

(51) Int. Cl.
*G03G 15/08* (2006.01)

(52) U.S. Cl.
CPC ..... *G03G 15/0868* (2013.01); *G03G 15/0856* (2013.01); *G03G 15/0889* (2013.01)

(58) Field of Classification Search
CPC ..... G03G 15/0856; G03G 15/0868; G03G 15/0889
See application file for complete search history.

(56) References Cited

U.S. PATENT DOCUMENTS 5,081,498 A * 1/1992 Bares ..... G03G 15/0848 118/689
6,208,816 B1 3/2001 Koizumi et al.
9,317,005 B2 * 4/2016 Monde ..... G03G 21/1652
2014/0037305 A1 2/2014 Monde et al.

FOREIGN PATENT DOCUMENTS

JP 06161242 6/1994
JP 2004-354904 12/2004
JP 2010-107978 5/2010

* cited by examiner

*Primary Examiner* — Hoang X Ngo
(74) *Attorney, Agent, or Firm* — Amin, Turocy & Watson, LLP

(57) ABSTRACT

According to one embodiment, an image forming apparatus includes a storage portion, a first electrode, a second electrode, a measuring unit, a detected portion, an image forming unit, and a controller. The storage portion stores a recording material. The measuring unit measures a change of capacitance between the first electrode and the second electrode. The detected portion is located inside the storage portion and is capable of moving so that at least one of a distance to the first electrode and a distance to the second electrode changes. The image forming unit forms an image with the recording material. The controller controls supplying of the recording material to the storage portion in response to the change of the capacitance measured by the measuring unit.

18 Claims, 8 Drawing Sheets

IMAGE FORMING APPARATUS AND STORAGE DEVICE

FIELD

Embodiments described herein relate generally to an image forming apparatus and a storage device.

BACKGROUND

The image forming apparatus in the related art uses a piezoelectric sensor or the like for detection of the presence or absence of a toner in a storage portion that stores the toner in a sub hopper or the like. However, a method of using a piezoelectric sensor or the like requires the formation of a hole on a wall surface of the storage portion, which may cause the leakage of the toner. In the method of using a piezoelectric sensor or the like, a sensor is expensive in many cases. In the method of using a piezoelectric sensor or the like, the power consumption of the sensor is large in many cases.

A method of detecting the presence or absence of a toner using a capacitance sensor is also proposed. However, if the capacitance sensor is used, there is a problem of not knowing the presence or absence of the toner in an initial state.

DETAILED DESCRIPTION

Figure 1:
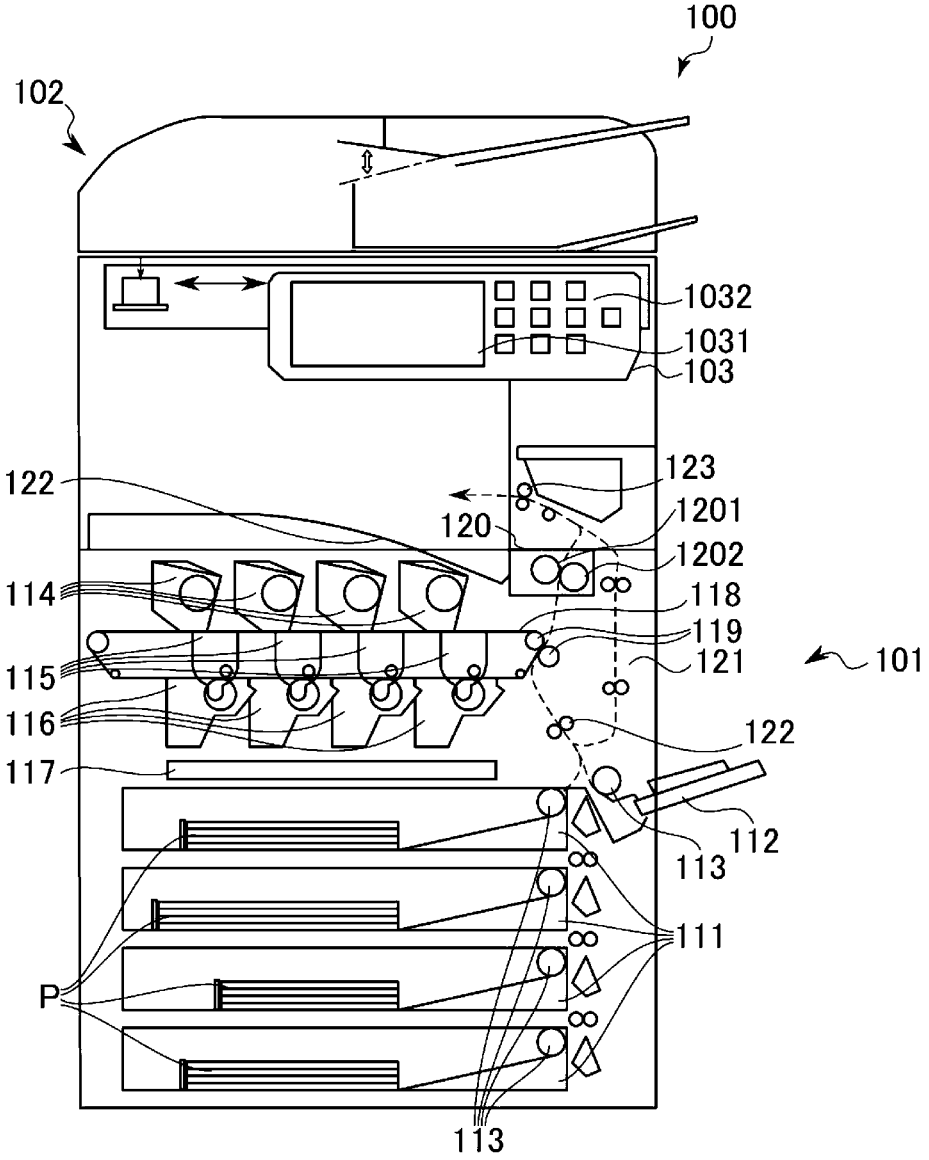
FIG. 1 is a diagram illustrating an example of a configuration of a main part of an image forming apparatus according to an embodiment.

In general, according to one embodiment, an image forming apparatus includes a storage portion, a first electrode, a second electrode, a measuring unit, a detected portion, an image forming unit, and a controller. The storage portion stores a recording material. The measuring unit measures a change of capacitance between the first electrode and the second electrode. The detected portion is located inside the storage portion and is capable of moving so that at least one of a distance to the first electrode and a distance to the second electrode changes. The image forming unit forms an image with the recording material. The controller controls supplying of the recording material to the storage portion in response to the change of the capacitance measured by the measuring unit. According to another embodiment, a toner handling method involves measuring a change of capacitance between a first electrode and a second electrode; moving a detected portion located inside a storage portion storing a recording material so that at least one of a distance to the first electrode and a distance to the second electrode changes; and controlling a supply of the recording material to the storage portion in response to the change of the capacitance measured.

Hereinafter, an image forming apparatus according to the embodiment will be described with reference to the drawings. In each drawing used for the description of the following embodiment, the scale of each part may be changed as appropriate. In each drawing used for the description of the following embodiment, illustration of the configuration may be omitted for the sake of description. In each drawing and the specification, the same reference numerals denote similar elements.

FIG. 1 is a diagram illustrating an example of a configuration of a main part of an image forming apparatus 100 according to the embodiment.

The image forming apparatus 100 is, for example, a multifunction peripheral (MFP), a copying machine, a printer, a facsimile, or the like. Hereinafter, the image forming apparatus 100 will be described as an MFP. The image forming apparatus 100 has, for example, a print function, a scan function, a copy function, a facsimile function, and the like. The print function is a function of forming an image on an image forming medium P or the like with a toner as a recording material. The image forming medium P is, for example, sheet-like paper or the like. The scan function is a function of reading an image from a document or the like on which an image is formed. The copy function is a function of printing the image read from the document or the like by using the scan function on the image forming medium P by using the print function. The image forming apparatus 100, includes, for example, a printer 101, a scanner 102, and an operation panel 103.

The printer 101 prints an image on the image forming medium P by forming the image with a toner or the like. The printer 101 includes, for example, the printer 101 of an electrophotographic system (laser) and performs printing with the printer 101. The printer 101 includes, for example, a paper feed tray 111, a manual feed tray 112, a paper feed roller 113, a toner cartridge 114, a sub hopper 115, an image forming unit 116, an optical scanning device 117, a transfer belt 118, a secondary transfer roller 119, a fixing unit 120, a duplex unit 121, a conveyance roller 122, and a paper discharge tray 123.

The paper feed tray 111 is a tray that stores the image forming medium P used for printing.

The manual feed tray 112 is a tray for manually feeding the image forming medium P.

The paper feed roller 113 carries out the image forming medium P stored in the paper feed tray 111 or the manual feed tray 112 from the paper feed tray 111 or the manual feed tray 112 by rotation due to an operation of a motor.

Three of one toner cartridge 114, one sub hopper 115, one image forming unit 116 are set as one set, and the image forming apparatus 100 includes one or a plurality of the corresponding sets. The image forming apparatus 100 includes, for example, four toner cartridges 114, four sub hoppers 115, and four image forming units 116 as illustrated in FIG. 1. The image forming apparatus 100 illustrated in FIG. 1 includes four corresponding sets. The four sets respectively correspond to toners of colors of cyan, magenta, yellow, and key (black) (CMYK). The image forming apparatus 100 illustrated in FIG. 1 includes four sets, for example, the set corresponding to a toner of a cyan color, the set corresponding to a toner of a magenta color, the set corresponding to a toner of a yellow color, and the set corresponding to a toner of a black color. The colors of the toners corresponding to the sets are not limited to the colors of CMYK, and may be other colors. The toner corresponding to the sets may be a special toner. Examples of the special toner include a decolorable toner that is decolored at a temperature higher than the fixing temperature to be in an invisible state.

The toner cartridge 114 as a holding portion stores (holds) a toner to be supplied to the sub hopper 115. The toners stored by the respective toner cartridges 114 are the toners of the colors corresponding to the respective toner cartridges 114.

The sub hopper 115 stores the toner supplied from the toner cartridge 114. The sub hopper 115 supplies the stored toner to the image forming unit 116.

Figure 2:
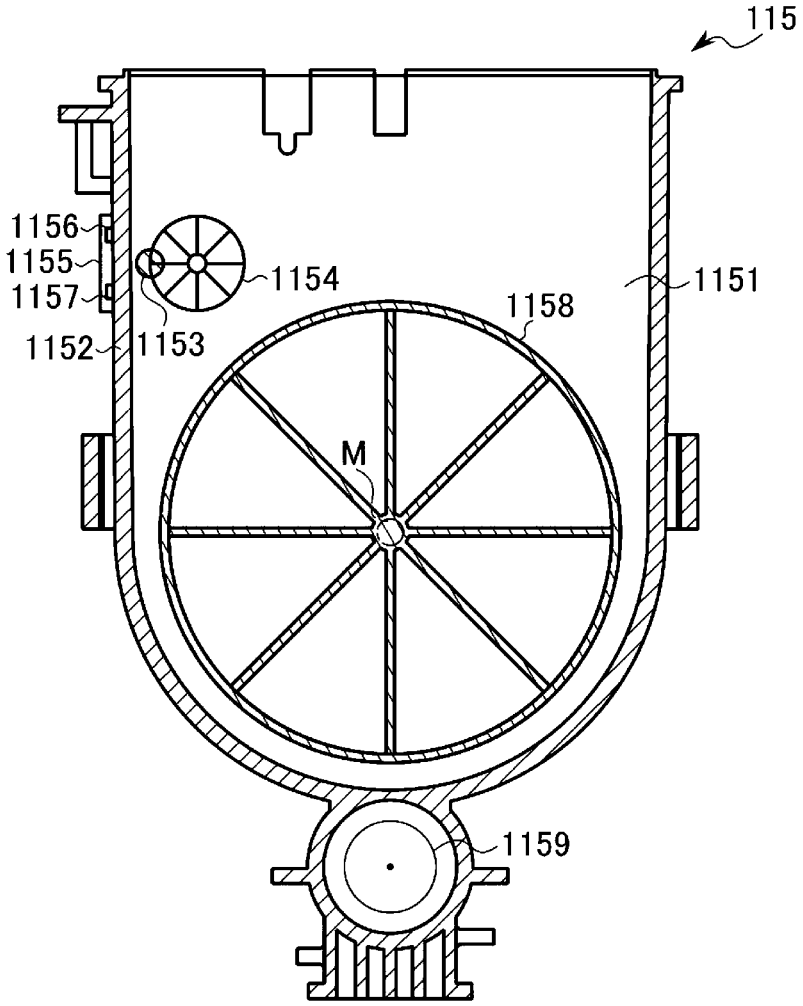
FIG. 2 is a cross-sectional view illustrating an example of a configuration of a main part of a sub hopper in FIG. 1.

FIG. 2 is a cross-sectional view illustrating an example of a configuration of a main part of the sub hopper 115. The sub hopper 115 includes, for example, a storage portion 1151, a wall surface 1152, a detected portion 1153, a first rotation body 1154, a substrate 1155, a first electrode 1156, a second electrode 1157, a second rotation body 1158, and a third rotation body 1159.

The storage portion 1151 stores a toner supplied from the toner cartridge 114.

The wall surface 1152 is a wall that surrounds the storage portion 1151. The inner side of the wall surface 1152 is the storage portion 1151.

The detected portion 1153 is made of, for example, a dielectric. The dielectric is, for example, a substance having a high relative dielectric constant. The shape of the detected portion 1153 is not limited, but is, for example, a sphere, a disc, or a column. The detected portion 1153 can move so that a distance to the first electrode 1156 and a distance to the second electrode 1157 change. The detected portion 1153 moves by the rotation of the first rotation body 1154. A voltage may not be applied to the detected portion 1153. A current may not be applied to the detected portion 1153.

The first rotation body 1154, the second rotation body 1158, and the third rotation body 1159 are connected to a motor M via a gear or the like. The first rotation body 1154, the second rotation body 1158, and the third rotation body 1159 rotate by the operation of the motor M. The first rotation body 1154, the second rotation body 1158, and the third rotation body 1159 may rotate by different motors, respectively.

The first rotation body 1154 is a circular member that rotates by the operation of the motor M. The detected portion 1153 is attached to the first rotation body 1154 on the outer side of a rotation axis. If the first rotation body 1154 rotates, the detected portion 1153 circularly moves. The first rotation body 1154 may include two or more detected portions 1153. The first rotation body 1154 may include the plurality of detected portions 1153 at equal intervals on the same circumference with the rotation axis as a center. The first rotation body 1154 includes a portion having a dielectric constant different from that of other portions on the same circumference with the rotation axis as a center, as a detected portion.

If the plurality of detected portions 1153 are provided at equal intervals on the same circumference with the rotation axis as a center, the weight is balanced, and thus the rotation of the first rotation body 1154 is less likely to shake. A counterweight and the like may be attached to the first rotation body 1154 for the balance of the weight. Otherwise, for the balance of the weight, the weight of the first rotation body 1154 may be caused to be heavier on the side opposite to a position where the detected portion 1153 is attached.

The substrate 1155 is attached to the outside of the wall surface 1152. The substrate 1155 includes a circuit for measuring capacitance between the first electrode 1156 and the second electrode 1157. The substrate 1155 outputs a capacitance signal indicating the capacitance.

The first electrode 1156 and the second electrode 1157 are, for example, patterns on the substrate 1155. Otherwise, the first electrode 1156 and the second electrode 1157 are conductor tapes adhering to the outside of the wall surface 1152. The conductor tapes are electrically connected to a wiring on the substrate 1155. The first electrode 1156 and the second electrode 1157 are not in contact with each other and have a distance therebetween.

The second rotation body 1158 is a circular member that rotates by the operation of the motor M. The second rotation body 1158 stirs a toner in the storage portion 1151 by the rotation.

The third rotation body 1159 is a circular member that rotates by the operation of the motor M. By the rotation of the third rotation body 1159, the toner in an amount corresponding to the rotation amount of the third rotation body 1159 is sent from the storage portion 1151 to the image forming unit 116.

The image forming unit 116 forms an image with the toner and transfers (primarily transfer) the image to the transfer belt 118.

Figure 3:
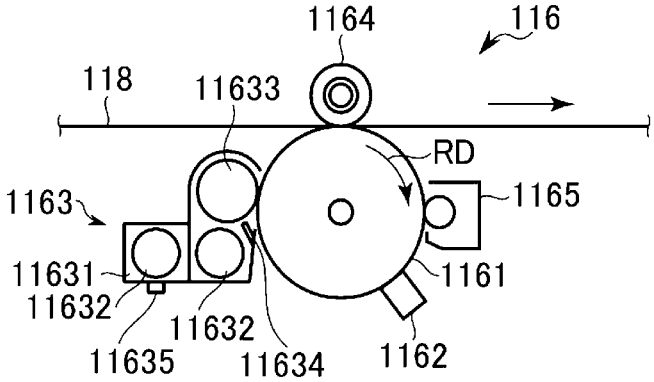
FIG. 3 is a diagram illustrating an example of a configuration of a main part of an image forming unit in FIG. 1.

FIG. 3 is a diagram illustrating an example of a configuration of a main part of the image forming unit 116. The image forming unit 116 includes, for example, a photosensitive drum 1161, a charging unit 1162, a developing unit 1163, a primary transfer roller 1164, and a cleaner 1165.

The photosensitive drum 1161 corresponds to a surface irradiated with beams from the optical scanning device 117. Accordingly, an electrostatic latent image is formed to the surface of the photosensitive drum 1161.

The charging unit 1162 charges the surface of the photosensitive drum 1161 with a positive charge.

The developing unit 1163 develops the electrostatic latent image on the surface of the photosensitive drum 1161 with the toner supplied from the sub hopper 115. Accordingly, the image is formed with the toner on the surface of the photosensitive drum 1161. The developing unit 1163 includes, for example, a developer container 11631, a stirring mechanism 11632, a developing roller 11633, a doctor blade 11634, and a toner sensor 11635.

The developer container 11631 is a container that stores a developer. The developer is, for example, a developer including two components of a toner and a carrier. The developer container 11631 receives the toner sent from the sub hopper 115 by the operation of the second rotation body

1158. The carrier is contained in the developer container 11631 when the image forming apparatus 100 is manufactured or set up.

The stirring mechanism 11632 is driven by the motor and stirs the toner and the carrier in the developer container 11631.

The developing roller 11633 rotates in the developer container 11631. Accordingly, the developer adheres to the surface of the developing roller 11633.

The doctor blade 11634 is a member that is disposed at an interval from the surface of the developing roller 11633. The doctor blade 11634 removes a portion of the developer that adheres to the surface of the rotating developing roller 11633. Accordingly, a layer of the developer having a thickness corresponding to the interval between the doctor blade 11634 and the surface of the developing roller 11633 is formed on the surface of the developing roller 11633.

For example, the toner sensor 11635 is a magnetic flux sensor including a coil and detecting a voltage value generated in the coil. The detected voltage of the toner sensor 11635 changes depending on the density of the magnetic flux from the toner in the developer container 11631. The toner sensor 11635 outputs a voltage according to the density (hereinafter, simply referred to as the "toner density") of the toner in the developer in the developer container 11631. The voltage output by the toner sensor 11635 is used for the measuring of the toner density in the developer container 11631.

The primary transfer roller 1164 generates a transfer voltage with the photosensitive drum 1161. Accordingly, the primary transfer roller 1164 transfers (primarily transfers) the image formed on the surface of the photosensitive drum 1161 to the transfer belt.

The cleaner 1165 removes the toner remaining on the surface of the photosensitive drum 1161.

The optical scanning device 117 is also referred to as a laser scanning unit (LSU) or the like. The optical scanning device 117 forms the electrostatic latent image on the photosensitive drum surface of the image forming unit 116 by controlling laser light in response to the input image data.

The transfer belt 118 is, for example, an endless belt and can rotate by the operation of the roller. The transfer belt 118 rotates to convey the images transferred from the image forming units 116 to the position of the secondary transfer roller 119.

The secondary transfer roller 119 includes two rollers facing each other. The secondary transfer roller 119 transfers (secondarily transfers) the image formed on the transfer belt 118 to the image forming medium P passing between the secondary transfer rollers 119.

The fixing unit 120 heats and pressurizes the image forming medium P to which the image is transferred. Accordingly, the image transferred to the image forming medium P is fixed. The fixing unit 120 includes a heating unit 1201 and a pressure roller 1202 facing each other. The fixing unit 120 includes, for example, the heating unit 1201 and the pressure roller 1202.

The heating unit 1201 is, for example, a roller including a heat source that heats the heating unit 1201. The heat source is, for example, a heater. The roller heated by the heat source heats the image forming medium P.

Otherwise, the heating unit 1201 may include an endless belt suspended by a plurality of rollers. For example, the heating unit 1201 includes a plate-like heat source, an endless belt, a belt conveyance roller, a tension roller, and a press roller. The endless belt is, for example, a film-like member. The belt conveyance roller drives the endless belt. The tension roller applies tension to the endless belt. The press roller forms an elastic layer on the surface. A portion on the heat generating portion side of the plate-like heat source is in contact with the inner side of the endless belt and is pressed in the press roller direction to form a nip with the press roller. Since the heating unit 1201 is configured such that the plate-like heat source performs heating while forming a nip area, the responsiveness at the time of energization is higher than in a case of the heating system with a halogen lamp.

The pressure roller 1202 pressurizes the image forming medium P passing between the pressure roller 1202 and the heating unit 1201.

The duplex unit 121 makes the image forming medium P ready for printing on the back surface. For example, the duplex unit 121 reverses the front and back of the image forming medium P by switching back the image forming medium P by using the roller or the like.

The conveyance roller 122 rotates by the operation of the motor to convey the image forming medium P.

The paper discharge tray 123 is a support to which the image forming medium P on which printing is completed is discharged.

A scanner 102 reads an image from a document or the like. The scanner 102 is, for example, an optical reduction system including an imaging device such as a charge-coupled device (CCD) image sensor. Otherwise, the scanner 102 is a contact image sensor (CIS) system including an imaging device such as a complementary metal-oxide-semiconductor (CMOS) image sensor. Otherwise, the scanner 102 may be other known systems.

An operation panel 103 includes a man-machine interface that performs input and output between the image forming apparatus 100 and an operator of the image forming apparatus 100. The operation panel 103 includes, for example, a touch panel 1031 and an input device 1032.

The touch panel 1031 is formed by stacking a pointing device that receives a touch input and a display such as a liquid crystal display or an organic electro-luminescence (EL) display. The display including the touch panel 1031 functions as a display device that displays a screen for notifying various kinds of information to the operator of the image forming apparatus 100. The touch panel 1031 functions as an input device that receives a touch operation by the operator.

The input device 1032 receives an operation by the operator of the image forming apparatus 100. The input device 1032 is, for example, a keypad or a touchpad.

Figure 4:
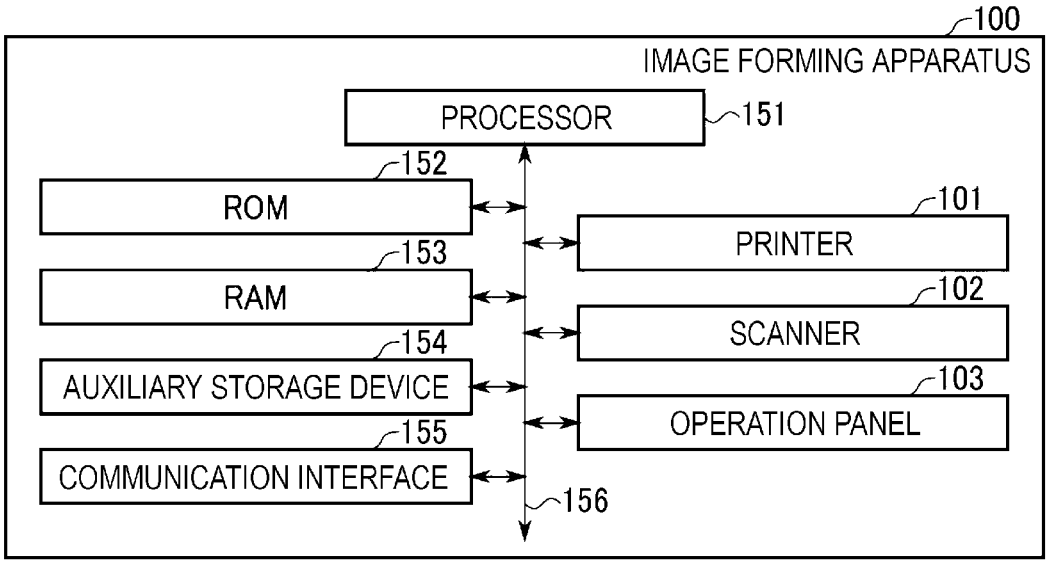
FIG. 4 is a block diagram illustrating an example of a circuit configuration of the main part of the image forming apparatus according to the embodiment.

FIG. 4 is a block diagram illustrating an example of a circuit configuration of a main part of the image forming apparatus 100.

The image forming apparatus 100 includes, for example, a processor 151, a read-only memory (ROM) 152, a random-access memory (RAM) 153, an auxiliary storage device 154, a communication interface 155, the printer 101, the scanner 102, and the operation panel 103. Moreover, a bus 156 or the like connects these units.

The processor 151 corresponds to a central part of a computer that performs a process such as calculation and control required for the operation of the image forming apparatus 100. The processor 151 controls each unit to realize various functions of the image forming apparatus 100 based on programs such as firmware, system software, and application software stored in the ROM 152, the auxiliary storage device 154, or the like. The processor 151 performs processes described below based on the program. A part or all of the program may be incorporated in the circuit of the processor 151. The processor 151 is, for example, a central processing unit (CPU), a micro processing unit (MPU), a system on a chip (SoC), a digital signal processor (DSP), a graphics processing unit (GPU), an application specific integrated circuit (ASIC), a programmable logic device (PLD), or a field-programmable gate array (FPGA). Otherwise, the processor 151 is a combination of a plurality of these.

The ROM 152 corresponds to the main memory of a computer with the processor 151 as the core. The ROM 152 is a non-volatile memory exclusively used for reading data. The ROM 152 stores, for example, firmware among the above programs. The ROM 152 also stores data or the like used by the processor 151 for performing various kinds of processes.

The RAM 153 corresponds to a main memory of a computer with the processor 151 as the core. The RAM 153 is a memory used for reading data. The RAM 153 is used as a work area for storing data that is temporarily used by the processor 151 for performing various kinds of processes. The RAM 153 is typically a volatile memory.

The auxiliary storage device 154 corresponds to an auxiliary storage device of a computer with the processor 151 as the core. The auxiliary storage device 154 is, for example, an electric erasable programmable read-only memory (EEPROM), a hard disk drive (HDD), or a flash memory. The auxiliary storage device 154 stores, for example, system software and application software among the above programs. The auxiliary storage device 154 stores data used by the processor 151 for performing various kinds of processes, data generated by the process of the processor 151, various setting values, and the like. The image forming apparatus 100 may include an interface into which a removable storage medium such as a memory card or a universal serial bus (USB) memory can be inserted, as the auxiliary storage device 154. The interface reads or writes information from or to the storage medium.

The auxiliary storage device 154 stores a threshold value T. The threshold value T will be described below.

The communication interface 155 is an interface for communication by the image forming apparatus 100 via a network such as the Internet or a local area network (LAN).

The bus 156 includes a control bus, an address bus, a data bus, and the like, and transmits signals transmitted and received by each unit of the image forming apparatus 100.

Hereinafter, the operation of the image forming apparatus 100 according to the embodiment will be described below.

Figure 5:
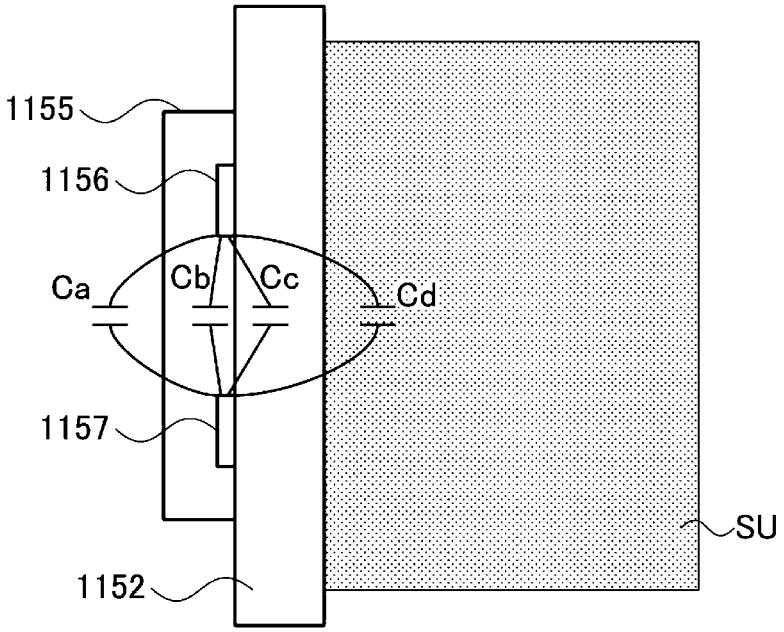
FIG. 5 is a diagram illustrating modelling of capacitance C between a first electrode and a second electrode in FIG. 2.

FIG. 5 is a diagram illustrating modelling of capacitance C between the first electrode 1156 and the second electrode 1157.

The capacitance C between the first electrode 1156 and the second electrode 1157 can be considered as the capacitance when a capacitor of capacitance Ca, a capacitor of capacitance Cb, a capacitor of capacitance Cc, and a capacitor of capacitance Cd are connected in parallel, as illustrated in FIG. 5. That is, the capacitance C can be represented by the expression of $$C \approx Ca+Cb+Cc+Cd \quad (1).$$

The capacitance Ca is the capacitance of the portion indicated by a line of electric force passing through the outside of the sub hoppers 115. The line of electric force mainly passes through the air.

The capacitance Cb is capacitance of a portion indicated by the line of electric force passing through the inside of the substrate 1155.

The capacitance Cc is capacitance of a portion indicated by the line of electric force passing through the inside of the wall surface 1152.

The capacitance Cd is capacitance of a portion indicated by the line of electric force reaching the second electrode 1157 from the first electrode 1156 through the inside of the wall surface 1152, a substance SU on the inner side of the wall surface 1152 (inside of the storage portion 1151), and the inside of the wall surface 1152 in this order.

Among the capacitance Ca to the capacitance Cd, the capacitance Ca to the capacitance Cc do not change regardless of the presence or absence and the amount of the toner in the storage portion 1151, and is thus ignored here.

Figure 6:
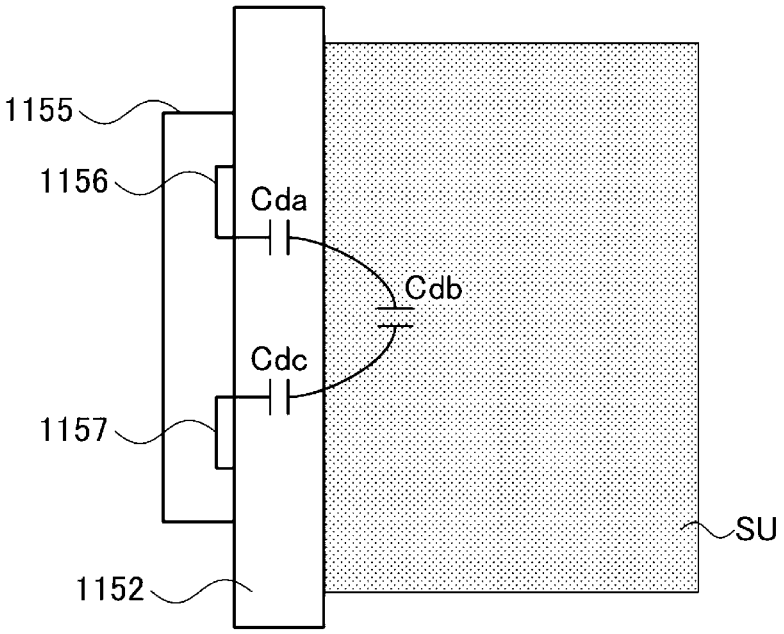
FIG. 6 is a diagram illustrating modelling of capacitance Cd.

FIG. 6 is a diagram illustrating modelling of the capacitance Cd.

As illustrated in FIG. 6, the capacitance Cd can be considered as capacitance when a capacitor of the capacitance Cda, a capacitor of the capacitance Cdb, and a capacitor of the capacitance Cdc are connected in series. That is, the capacitance Cd can be represented by the expression of $$Cd \approx 1/(1/Cda+1/Cdb+1/Cdc) \quad (2).$$

The capacitance Cda is capacitance indicated by a portion passing through the inside of the wall surface 1152 from the first electrode 1156 to the inner wall of the wall surface 1152 in the line of electric force reaching the second electrode 1157 from the first electrode 1156 through the inside of the wall surface 1152, the substance SU in the storage portion 1151, and the inside of the wall surface 1152 in this order.

The capacitance Cdb is capacitance indicated by the portion passing through the substance SU in the storage portion 1151 in the line of electric force reaching the second electrode 1157 from the first electrode 1156 through the inside of the wall surface 1152, the substance SU in the storage portion 1151, and the inside of the wall surface 1152 in this order.

The capacitance Cdc is capacitance indicated by the portion passing through the inside of the wall surface 1152 from the second electrode 1157 to the inner wall of the wall surface 1152 in the line of electric force reaching the second electrode 1157 from the first electrode 1156 through the inside of the wall surface 1152, the substance SU in the storage portion 1151, and the inside of the wall surface 1152 in this order.

Among the capacitance Cda to the capacitance Cdc, the capacitance Cda and capacitance Cdc do not change regardless of the presence or absence and amount of the toner in the storage portion 1151 and is thus ignored here.

Figure 7:
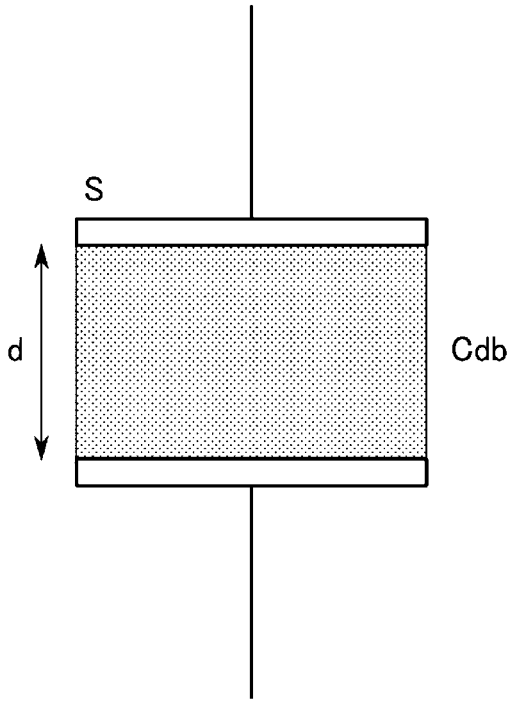
FIG. 7 is a diagram illustrating capacitance Cdb when a detected portion in FIG. 2 is sufficiently separated from the first electrode and the second electrode in FIG. 2, by replacing the capacitance with a model of a parallel plate capacitor.

FIG. 7 is a diagram illustrating the capacitance Cdb when the detected portion 1153 is sufficiently separated from the first electrode 1156 and the second electrode 1157, by replacing the capacitance with a model of a parallel plate capacitor.

If the detected portion 1153 is sufficiently separated from the first electrode 1156 and the second electrode 1157, the presence of the detected portion 1153 hardly influences the capacitance Cdb, and thus the capacitance Cdb can be obtained regardless of the presence of the detected portion 1153.

In this model, for easier calculation, the capacitor of the capacitance Cdb is regarded as a parallel plate capacitor.

Accordingly, if a distance between the parallel plates is set as d, an area of the parallel plate is set as S, a vacuum dielectric constant is set as $\varepsilon_0$, and a relative dielectric constant of the substance SU is set as $\varepsilon$, the capacitance Cdb when the detected portion 1153 is sufficiently separated from the first electrode 1156 and the second electrode 1157 can be represented by the expression of $$Cdb \approx \varepsilon_0 \varepsilon S/d \quad (3).$$

Figure 8:
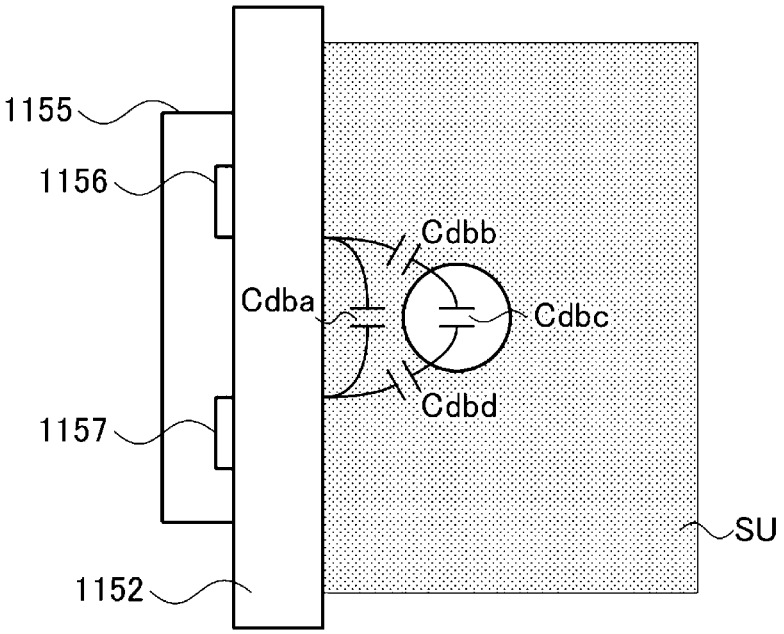
FIG. 8 is a diagram illustrating modelling of the capacitance Cdb in a state in which the detected portion in FIG. 2 is the closest to the first electrode and the second electrode in FIG. 2.

FIG. 8 is a diagram illustrating modelling of the capacitance Cdb in a state in which the detected portion 1153 is the closest to the first electrode 1156 and the second electrode 1157.

If the detected portion 1153 is present, the capacitance Cdb can be considered as capacitance when a capacitor of capacitance Cdba of the portion where the line of electric force only passes through the inside of the substance SU without passing through the detected portion 1153 and a capacitor of the portion where the line of electric force passes through the detected portion 1153 are connected in parallel.

The capacitance of the capacitor of the portion where the line of electric force passes through the detected portion 1153 is considered as the capacitance when a capacitor of capacitance Cdbb, a capacitor of capacitance Cdbc, and a capacitor of capacitance Cdbd are connected in series. That is, capacitance Cdb can be represented by the expression of $$Cdb \approx Cdba + 1/(1/Cdbb + 1/Cdbc + 1/Cdbd) \quad (4).$$

The capacitance Cdbb is the capacitance Cdbc of the portion indicated by the line of electric force passing through only the inside of the substance SU from the inner wall of the wall surface 1152 to the detected portion 1153.

The capacitance Cdbc is the capacitance of the portion indicated by the line of electric force passing through the inside of the detected portion 1153 only.

The capacitance Cdbd is the capacitance of the portion indicated by the line of electric force passing through only the inside of the substance SU from the detected portion 1153 to the inner wall of the wall surface 1152.

Figure 9:
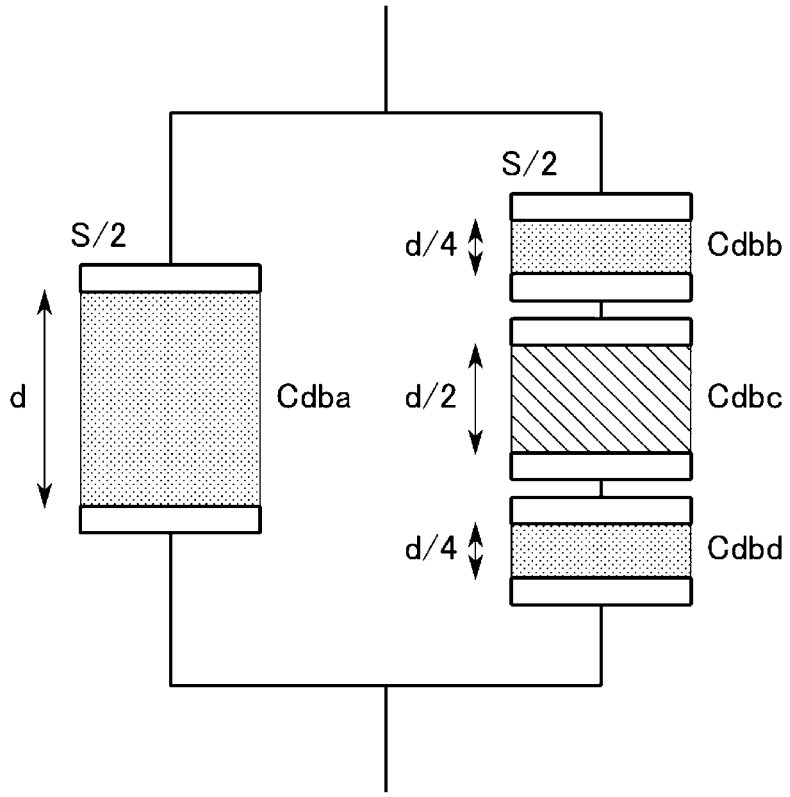
FIG. 9 is a diagram illustrating the capacitance Cdb in a state in which the detected portion in FIG. 2 is the closest to the first electrode and the second electrode in FIG. 2, by replacing the capacitance with a model of a parallel plate capacitor.

FIG. 9 is a diagram illustrating the capacitance Cdb in a state in which the detected portion 1153 is the closest to the first electrode 1156 and the second electrode 1157, by replacing the capacitance with a model of a parallel plate capacitor.

In the model illustrated in FIG. 9, the areas of the parallel plates of the parallel plate capacitors of the capacitance Cdba to the capacitance Cdbd each are set as S/2 for easier calculation. In the model illustrated in FIG. 9, a distance between the parallel plates of the capacitor of the capacitance Cdba is set as d. In the model illustrated in FIG. 9, a distance of the parallel plates of the capacitor of the capacitance Cdbb is set as d/4, a distance between the parallel plates of the capacitor of the capacitance Cdbc is set as d/2, and a distance between the parallel plates of the capacitor of the capacitance Cdbd is set as d/4. In this case, if the dielectric constant of the detected portion 1153 is set as $\varepsilon_R$, the capacitance Cdb can be represented by the expression of $$Cdb \approx \varepsilon\varepsilon_0 S/2d + 1/(1/(2\varepsilon\varepsilon_0 S/d) + 1/(\varepsilon_R \varepsilon_0 S/d) + 1/(2\varepsilon\varepsilon_0 S/d)) \quad (5)$$

Expression (5) is summarized as $$Cdb \approx (1/2 + \varepsilon_R/(\varepsilon + \varepsilon_R))\varepsilon\varepsilon_0(S/d) \quad (6).$$

From the above, a difference Cdif between the capacitance Cdb when the detected portion 1153 is sufficiently separated from the first electrode 1156 and the second electrode 1157 and the capacitance Cdb in a state in which the detected portion 1153 is the closest to the first electrode 1156 and the second electrode 1157 can be represented by the expression of $$Cdif \approx (1/2 + \varepsilon_R/(\varepsilon + \varepsilon_R))\varepsilon\varepsilon_0(S/d) - \varepsilon_0 \varepsilon S/d \quad (7)$$

from Expressions (3) and (6). Expression (7) is summarized as $$Cdif \approx (\varepsilon_R/(\varepsilon + \varepsilon_R) - 1/2)\varepsilon\varepsilon_0(S/d) \quad (8).$$

From Expression (8), it is understood that as the relative dielectric constant of the substance SU is higher, the change amount of the capacitance C due to the movement of the detected portion 1153 increases. Since the relative dielectric constant of the toner is higher than the relative dielectric constant of the air, if the storage portion 1151 is filled with the toner, compared with a case where the storage portion 1151 is empty, the change amount of the capacitance C due to the movement of the detected portion 1153 increases.

From Expression (8), it is understood that as the relative dielectric constant of the detected portion 1153 is higher, the change amount of the capacitance C due to the movement of the detected portion 1153 increases.

Figure 10:
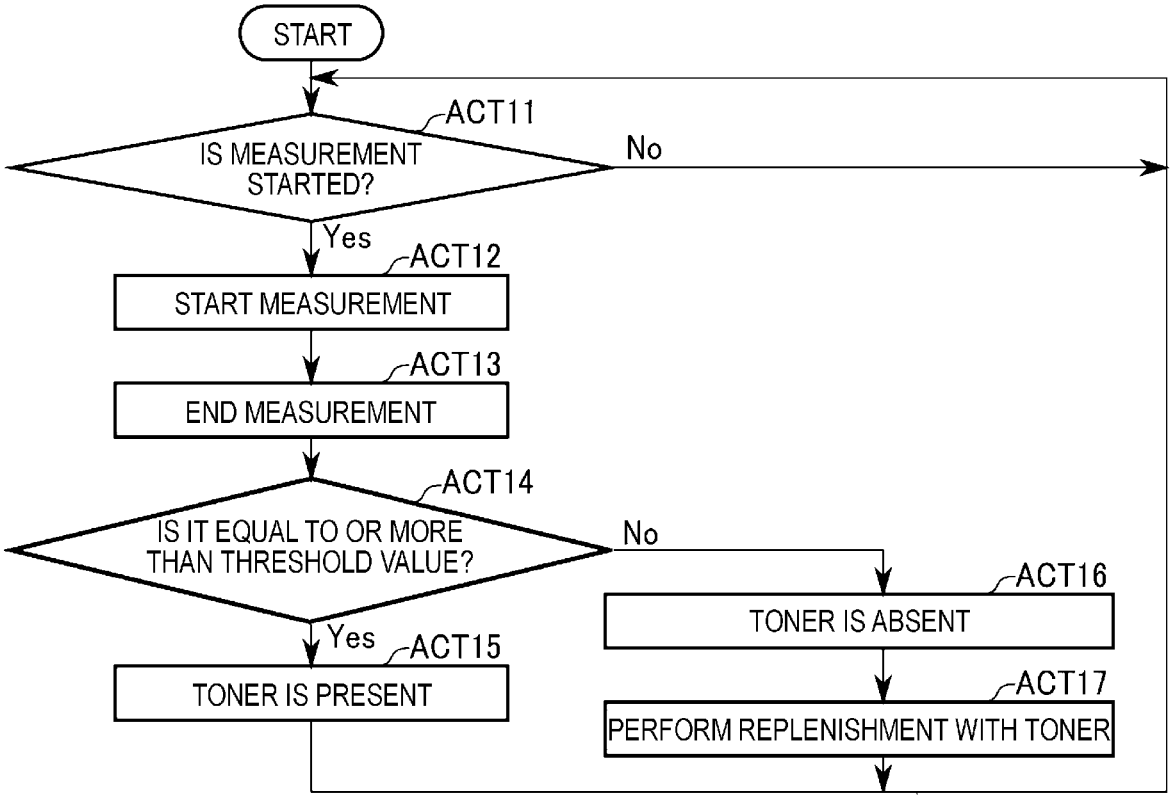
FIG. 10 is a flowchart illustrating an example of a process by a processor 151 in FIG. 4.

FIG. 10 is a flowchart illustrating an example of a process of the processor 151 of the image forming apparatus 100. The processor 151 executes the process of FIG. 10, for example, based on the program stored in the ROM 152 or the auxiliary storage device 154. The processor 151 performs the process illustrated in FIG. 10 for the colors of CMYK.

In ACT 11, the processor 151 determines whether to start the detection of the presence or absence of the toner in the storage portion 1151. With respect to the presence or absence of the toner, a case where an amount of the toner in the storage portion 1151 is equal to or more than a predetermined amount is regarded that the toner is present, and a case where the amount of the toner is less than a predetermined amount is regarded that the toner is absent. The predetermined amount is, for example, an amount in which the detected portion 1153 is immersed in the toner. The processor 151 determines to start the detection of the presence or absence of the toner, for example, at fixed time intervals. Otherwise, the processor 151 determines to start the detection of the presence or absence of the toner, for example, if printing is performed. If the processor 151 does not determine to start the detection of the presence or absence of the toner in the storage portion 1151, the processor 151 determines No in ACT 11 and repeats ACT 11. In contrast, if the processor 151 determines to start the detection of the presence or absence of the toner in the storage portion 1151, the processor 151 determines Yes in ACT 11 and proceeds to ACT 12.

In ACT 12, the processor 151 starts the measurement of a change amount Cpp of the capacitance C. Therefore, the processor 151 controls the motor M so that the first rotation body 1154 rotates. The processor 151 receives an input of the capacitance signal output by the substrate 1155.

Figure 11:
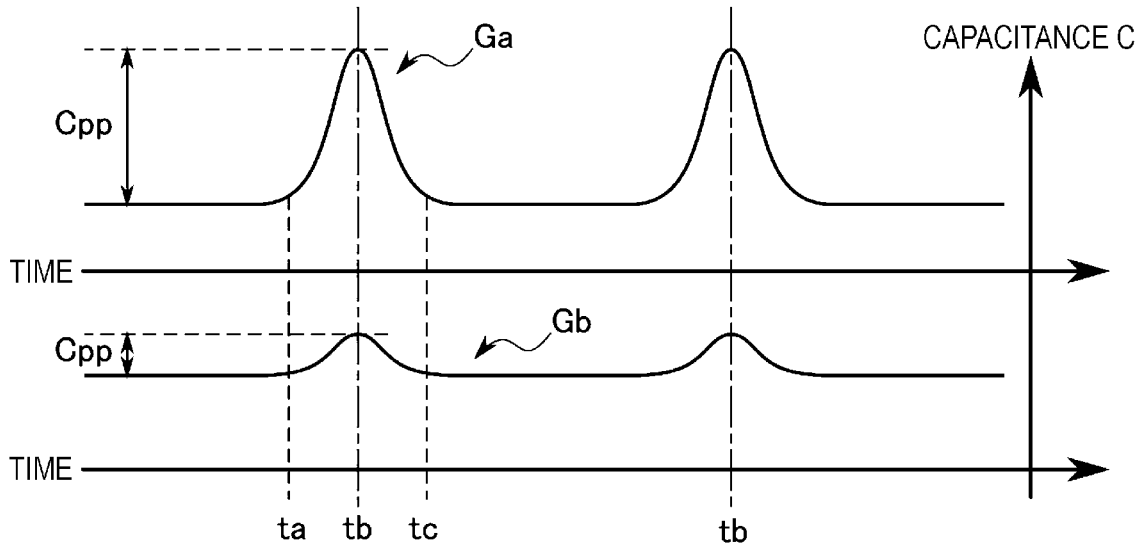
FIG. 11 is a graph illustrating a change of the capacitance C with time.

FIG. 11 is a graph illustrating the change of the capacitance C with time. FIG. 11 illustrates a graph Ga when the storage portion 1151 is filled with the toner and a graph Gb when the storage portion 1151 is empty (filled with the air). The graphs illustrated in FIG. 11 are graphs when the number of the detected portion 1153 is 1.

From time ta to time tc, the detected portion 1153 is close to the first electrode 1156 and the second electrode 1157, and thus the capacitance C increases. Moreover, at time tb, the detected portion 1153 is the closest to the first electrode 1156 and the second electrode 1157, and thus the size of the capacitance C is the largest.

The change amount Cpp of the capacitance C is, for example, peak-to-peak as illustrated in FIG. 11.

From the above, by performing the process of ACT 12, the processor 151 functions as a measuring unit that measures the change of the capacitance C in cooperation with the substrate 1155.

In ACT 13, the processor 151 ends the measurement of the change amount Cpp of the capacitance C. Therefore, the processor 151 controls the motor M to stop the rotation of the first rotation body 1154.

In ACT 14, the processor 151 determines whether the change amount Cpp of the capacitance C is equal to or more than the threshold value T. The threshold value T is a value for determining whether the toner is present in the storage portion 1151. If the change amount Cpp is equal to or more than the threshold value T, it can be regarded that the toner is present in the storage portion 1151. Moreover, if the change amount Cpp is less than the threshold value T, it can be regarded that the toner is absent in the storage portion 1151. In the graph Ga illustrated in FIG. 11, the change amount Cpp is equal to or more than the threshold value T. Moreover, in the graph Gb, the change amount Cpp is less than the threshold value T. If the change amount Cpp is equal to or more than the threshold value T, the processor 151 determines Yes in ACT 14 and proceeds to ACT 15.

In ACT 15, the processor 151 stores a value indicating that the toner is present in the storage portion 1151 in the auxiliary storage device 154 or the like. The processor 151 recognizes that the toner is present in the storage portion 1151 by referring to the value later. After the process of ACT 15, the processor 151 returns to ACT 11.

In contrast, if the change amount Cpp is less than the threshold value T, the processor 151 determines No in ACT 14 and proceeds to ACT 16.

In ACT 16, the processor 151 stores the value indicating that the toner is absent in the storage portion 1151 in the auxiliary storage device 154 or the like. The processor 151 recognizes that the toner is absent in the storage portion 1151 by referring to the value later.

From the above, the processor 151 functions as a determination unit by performing the processes of ACT 14 and ACT 15.

In ACT 17, the processor 151 controls the units of the toner cartridges 114 and the like so that the sub hoppers 115 are replenished with the toners. After the process of ACT 17, the processor 151 returns to ACT 11.

From the above, by performing the processes of ACT 14 and ACT 17, the processor 151 functions as a controller for controlling the supplying of the toner to the storage portion 1151 in response to the change of the capacitance C.

The image forming apparatus 100 of the embodiment includes the detected portion 1153 that can move in the storage portion 1151 so that the distances to the first electrode 1156 and the second electrode 1157 change. The detected portion moves so that the distances to the first electrode 1156 and the second electrode 1157 change, and thus the capacitance C between the first electrode 1156 and the second electrode 1157 changes. The image forming apparatus 100 measures the change amount Cpp. Accordingly, the image forming apparatus 100 of the embodiment can detect the presence or absence of the toner in the storage portion 1151. The image forming apparatus 100 of the embodiment can detect the presence or absence of the toner without making a hole in the wall surface 1152 of the storage portion 1151. The image forming apparatus 100 of the embodiment does not use an expensive piezoelectric sensor, and thus the cost can be reduced. The image forming apparatus 100 of the embodiment does not use a piezoelectric sensor that consumes a large amount of power, and thus the power consumption can be reduced. Since the change amount Cpp is used, the image forming apparatus 100 of the embodiment can detect the presence or absence of the toner even if the presence or absence of the toner in an initial state is not known.

If the change amount Cpp is equal to or more than the threshold value T, the image forming apparatus 100 of the embodiment regards that the toner is present in the storage portion 1151 and, if the change amount Cpp is less than the threshold value T, the image forming apparatus 100 regards that the toner is absent in the storage portion 1151. By using the threshold value in this manner, the image forming apparatus 100 of the embodiment can easily determine the presence or absence of the toner.

If the change amount Cpp is less than the threshold value T, the image forming apparatus 100 of the embodiment replenishes the sub hoppers 115 with the toners. Accordingly, the image forming apparatus 100 of the embodiment can make the amount of the toners in the sub hoppers 115 not to be reduced too much.

The image forming apparatus 100 of the embodiment causes the detected portion 1153 to circularly move on the same circumference with the rotation axis as the center.

The toner has a sufficiently high dielectric constant, and thus can be detected by the mechanism of the embodiment.

The image forming apparatus 100 of the embodiment detects the presence or absence of the toner in the storage portion 1151 included in the sub hopper 115 by the capacitance sensor. In contrast, a sub hopper in the related art detects the presence or absence of the toner by using a piezoelectric sensor. Accordingly, the sub hopper 115 of the embodiment uses a capacitance sensor more economical than the piezoelectric sensor and thus the manufacturing cost can be more reduced than in the related art.

The above embodiment can be modified as follows.

The detected portion 1153 may be made of a conductor.

Figure 12:
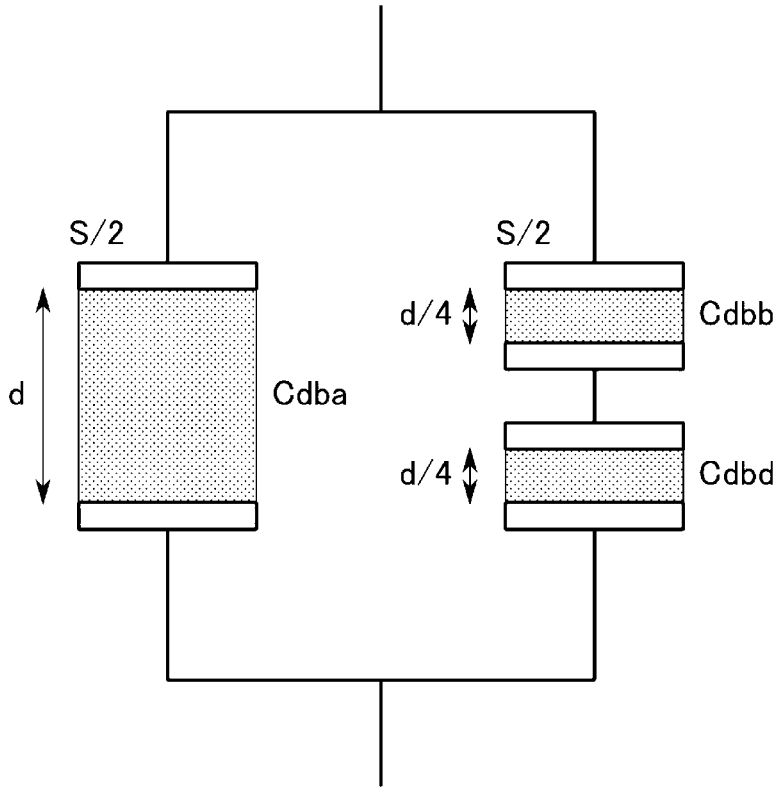
FIG. 12 is a diagram illustrating the capacitance Cdb in a state in which the detected portion made of a conductor is the closest to the first electrode and the second electrode in FIG. 2, by replacing the capacitance with a model of a parallel plate capacitor.

FIG. 12 is a diagram illustrating the capacitance Cdb in a state in which the detected portion 1153 made of a conductor is the closest to the first electrode 1156 and the second electrode 1157, by replacing the capacitance with a model of a parallel plate capacitor.

In the model illustrated in FIG. 12, differently from the model illustrated in FIG. 9, the capacitance of the portion where the line of electric force passes through the detected portion 1153 is capacitance when the capacitor of the capacitance Cdbb is connected to the capacitor of the capacitance Cdbd in series. This is because the detected portion 1153 works as an electrode. Accordingly, the capacitance Cdb can be represented by the expression of $$Cdb \approx Cdba + 1/(1/Cdbb + 1/Cdbd) \quad (9).$$

Expression (9) can be represented by $$Cdb \approx \varepsilon\varepsilon_0 S/2d + 1/(1/(2\varepsilon\varepsilon_0 S/d) + 1/(2\varepsilon\varepsilon_0 S/d)) \quad (10).$$

Expression (10) is summarized as $$Cdb \approx (3/2)\varepsilon\varepsilon_0(S/d) \quad (11).$$

In this case, the difference Cdif between the capacitance Cdb when the detected portion 1153 is sufficiently separated from the first electrode 1156 and the second electrode 1157 and the capacitance Cdb in a state in which the detected portion 1153 is the closest to the first electrode 1156 and the second electrode 1157 satisfies $$Cdif \approx (1/2)\varepsilon\varepsilon_0(S/d) \quad (12)$$

from Expressions (3) and (11).

Accordingly, it is understood that, even if the detected portion 1153 is made of a conductor, in the same manner as in a case where the detected portion 1153 is made of a dielectric, as the relative dielectric constant of the substance SU is higher, the change amount of the capacitance C due to the movement of the detected portion 1153 increases. It is understood that since the relative dielectric constant of the toner is higher than the relative dielectric constant of the air, if the storage portion 1151 is filled with the toner, compared with a case where the storage portion 1151 is empty, the change amount of the capacitance C due to the movement of the detected portion 1153 increases.

It is considered that if the detected portion 1153 is made of a dielectric, the detected portion 1153 is hardly charged. Therefore, in view of suppressing the influence of the change of the capacitance C due to the charge of the detected portion 1153, it is considered that the detected portion 1153 is preferably made of a dielectric.

The detected portion 1153 may be attached to the second rotation body 1158. In this case, the substrate 1155, the first electrode 1156, and the second electrode 1157 are installed at a position where the value of the capacitance between the first electrode 1156 and the second electrode 1157 changes by the movement of the detected portion 1153 due to the rotation of the second rotation body 1158. In this case, the second rotation body 1158 and the motor M are examples of a rotation unit.

The developer according to the embodiment is a developer including two components of a toner and a carrier. The developer may be a developer including one component of a toner only. The developer may be a developer including other components and may be a developer including three or more components.

The image forming apparatus of the embodiment may detect the presence or absence of the developer in the developing unit by using the mechanism according to the embodiment. The developing unit in this case includes, for example, a first electrode, a second electrode, and a substrate on an outer wall of the wall surface, and a rotation body and a detected portion on the inner side of the developing unit. The developing unit may use a stirring mechanism as a rotation body. The developing unit according to the embodiment usually does not run out of developer. However, in the developing unit in case of using the developer including one component of the toner only, the developer in the developing unit decreases, and thus the mechanism according to the embodiment is useful.

The developing unit as above is an example of a storage device.

The image forming apparatus of the embodiment may detect the presence or absence of the toner in the toner cartridge by using only the mechanism according to the embodiment. The toner cartridge in this case includes, for example, a first electrode, a second electrode, and a substrate on the outer wall of the wall surface and a rotation body and a detected portion on the inner wall of the developing unit. The toner cartridge may use a stirring mechanism as a rotation body.

The toner cartridge as above is an example of a storage device.

The image forming apparatus 100 of the embodiment causes the detected portion 1153 to circularly move on the same circumference with the rotation axis as the center. However, the movement path of the detected portion 1153 is not limited to the same circumference with the rotation axis as the center. For example, the image forming apparatus of the embodiment may reciprocate the detected portion 1153.

The capacitance C increases if a distance between the detected portion 1153 and the both of the first electrode 1156 and the second electrode 1157 decreases. Moreover, the capacitance C decreases if the distance between the detected portion 1153 and the both of the first electrode 1156 and the second electrode 1157 increases. However, if a distance between the detected portion 1153 and one electrode is constant, and only a distance between the detected portion 1153 and the other electrode increases, the capacitance decreases. Moreover, if a distance between the detected portion 1153 and one electrode is constant, and only a distance between the detected portion 1153 and the other electrode decreases, the capacitance increases. It is considered that the movement path of the detected portion 1153 may be a path in which a distance to at least one of the first electrode 1156 and the second electrode 1157 changes. It is considered that if the movement path of the detected portion 1153 is a path in which distances to the both of the first electrode 1156 and the second electrode 1157 change, the change amount of the capacitance increases.

A method of moving the detected portion 1153 may be performing the movement by using gravity or buoyancy applied to the detected portion.

The image forming apparatus of the embodiment may be configured to directly supply the toner from the toner cartridge to the developing unit.

According to the embodiment, the image forming apparatus 100 detects the presence or absence of the toner in the storage portion 1151. The image forming apparatus 100 may measure the remaining amount of the toner in the storage portion 1151. The processor 151 obtains the remaining amount of the toner by using the change amount Cpp or the like. It is considered that, as the change amount of the capacitance C increases, the more toners are present. This is because, depending on the remaining amount of the toner, the detected portion 1153 moves to go out of the toner in the storage portion 1151 or go into the toner. The processor 151 obtains the remaining amount of the toner, for example, by a function using the change amount Cpp. The processor 151 may obtain the remaining amount of the toner by using a value of the capacitance C instead of the change amount of the capacitance.

The image forming apparatus 100 according to the embodiment detects the presence or absence of the toner. However, the image forming apparatus of the embodiment may detect the presence or absence of substances other than the toner. For example, the image forming apparatus of the embodiment may detect the presence or absence of ink as a recording material. The printer included in the image forming apparatus in this case is, for example, an inkjet printer using ink as the recording material. The image forming apparatus in this case detects the presence or absence of the ink, for example, in an ink cartridge, an ink tank, or an inkjet head that stores ink. The inkjet printer may eject a liquid including conductive particles for forming a wiring pattern of a printed wiring substrate, a liquid including cells for artificially forming a tissue or an organ, a binder such as an adhesive, a wax, a liquid resin, or the like. The inkjet printer is not limited to a printer forming a two-dimensional image and may be a three-dimensional (3D) printer, an industrial manufacturing machine, or the like.

The above ink cartridge, ink tank, or inkjet head is an example of a storage device.

In the above embodiment, the case of detecting the presence or absence of the toner is described. However, it is also possible to detect the presence or absence of other substances by using the mechanism. A device of detecting the presence or absence of the other substances can detect the presence or absence of powder other than the toner, liquid other than ink, gas, a solid, or a dispersion system in the storage portion. As the relative dielectric constant is closer to 1, the detection becomes difficult. Therefore, the substance to be detected is required to be a substance having a relative dielectric constant sufficiently larger than 1.

The processor 151 may realize a part or all of the processes realized by the program in the embodiment by the hardware configuration of the circuit.

The devices of the embodiment are transferred to, for example, administrators of the devices in a state of storing programs for executing the processes. Otherwise, the devices are transferred to the administrators in a state of not storing the programs. Moreover, the programs are separately transferred to the administrators and stored in the devices based on operations by the administrators or servicemen. The transfer of the program in this case can be realized, for example, by using a removable storage medium such as a disk medium or a semiconductor memory, or by being downloaded via the Internet or LAN.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a storage portion configured to store a recording material;

a first electrode located outside the storage portion;

a second electrode located outside the storage portion and located at a predetermined distance from the first electrode;

a measuring component configured to measure a change of capacitance between the first electrode and the second electrode;

a detected dielectric located inside the storage portion and configured to move so that at least one of a distance to the first electrode and a distance to the second electrode changes;

an image forming component configured to form an image with the recording material; and a controller configured to control supplying of the recording material to the storage portion in response to the change of the capacitance measured by the measuring component.

2. The image forming apparatus according to claim 1, wherein the detected dielectric moves to go out of the recording material in the storage portion or go into the recording material in the storage portion.

3. The image forming apparatus according to claim 1, wherein a change amount of the capacitance varies depending on an amount of the recording material between the detected dielectric and the first electrode.

4. The image forming apparatus according to claim 1, wherein, if an amount of the recording material between the detected dielectric and the first electrode is large, a change amount of the capacitance is large, and if an amount of the recording material between the detected dielectric and the first electrode is small, the change amount of the capacitance is small.

5. The image forming apparatus according to claim 1, further comprising:

a holding portion configured to hold the recording material supplied to the storage portion, wherein, if a change amount of the capacitance due to movement of the detected dielectric is less than a threshold value, the controller supplies the recording material from the holding portion to the storage portion.

6. The image forming apparatus according to claim 1, further comprising:

a first rotation component configured to rotate the detected dielectric so that the distance to the first electrode and the distance to the second electrode change; and a second rotation component located below the first rotation component and configured to stir the recording material in the storage portion.

7. The image forming apparatus according to claim 6, wherein a weight of a rotation body including the rotation component and the detected dielectric is balanced.

8. The image forming apparatus according to claim 1, wherein the recording material comprises a toner.

9. A storage device, comprising:

a storage portion configured to store a recording material;

a first electrode located outside the storage portion;

a second electrode located outside the storage portion and located at a predetermined distance from the first electrode; and a detected dielectric located inside the storage portion and configured to move so that at least one of a distance to the first electrode and a distance to the second electrode changes.

10. The storage device according to claim 9, wherein the detected dielectric moves to go out of the recording material in the storage portion or go into the recording material in the storage portion.

11. The storage device according to claim 9, further comprising:

a first rotation component configured to rotate the detected dielectric so that the distance to the first electrode and the distance to the second electrode change; and a second rotation component located below the first rotation component and configured to stir the recording medium in the storage portion.

12. The storage device according to claim 11, wherein a weight of a rotation body including the rotation component and the detected dielectric is balanced.

13. The storage device according to claim 9, wherein the recording material comprises a toner.

14. A toner handling method, comprising:

measuring a change of capacitance between a first electrode and a second electrode, wherein the first electrode and the second electrode are located outside of a storage portion storing a recording medium and are spaced a predetermined distance apart;

moving a detected dielectric located inside the storage portion so that at least one of a distance to the first electrode and a distance to the second electrode changes; and controlling a supply of the recording material to the storage portion in response to the change of the capacitance measured.

15. The toner handling method according to claim 14, wherein a change amount of the capacitance varies depending on an amount of the recording material between the detected dielectric and the first electrode.

16. The toner handling method according to claim 14, wherein, if an amount of the recording material between the detected dielectric and the first electrode is large, a change amount of the capacitance is large, and if an amount of the recording material between the detected dielectric and the first electrode is small, the change amount of the capacitance is small.

17. The toner handling method according to claim 14, further comprising:

holding the recording material supplied to the storage portion; and if a change amount of the capacitance due to movement of the detected dielectric is less than a threshold value, supplying the recording material from the holding portion to the storage portion.

18. The toner handling method according to claim 14, further comprising:

rotating the detected dielectric so that the distance to the first electrode and the distance to the second electrode change.

* * * * *